US009435070B2

(12) United States Patent
Bae et al.

(10) Patent No.: US 9,435,070 B2
(45) Date of Patent: Sep. 6, 2016

(54) CLOTHING DRYER

(71) Applicant: SAMSUNG ELECTRONICS CO., LTD., Suwon-si, Gyeonggi-do (KR)

(72) Inventors: Byeong Won Bae, Gimhae-si (KR); Chang Bae Yeom, Yongin-si (KR); Sam Young Jang, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 107 days.

(21) Appl. No.: 14/551,323

(22) Filed: Nov. 24, 2014

(65) Prior Publication Data

US 2015/0152588 A1 Jun. 4, 2015

(30) Foreign Application Priority Data

Dec. 2, 2013 (KR) ..... 10-2013-0148645

(51) Int. Cl.
*D06F 58/28* (2006.01)
*D06F 58/22* (2006.01)
*D06F 58/04* (2006.01)

(52) U.S. Cl.
CPC ..... *D06F 58/28* (2013.01); *D06F 58/04* (2013.01); *D06F 58/22* (2013.01); *D06F 2058/2838* (2013.01)

(58) Field of Classification Search
CPC ..... F26B 21/00; F26B 25/00; F26B 25/16; D06F 58/00; D06F 58/22; D06F 58/28
USPC ..... 34/108, 595, 601, 606, 610; 68/5 C, 5 R, 68/19, 20; 8/139, 149, 159
See application file for complete search history.

(56) References Cited

U.S. PATENT DOCUMENTS 4,621,438 A * 11/1986 Lanciaux ..... D06F 58/04 34/242
4,899,464 A * 2/1990 Carr ..... D06F 58/04 34/604
5,709,040 A * 1/1998 Horwitz ..... D06F 58/22 34/565
6,385,862 B1 * 5/2002 Vande Haar ..... D06F 58/04 34/106
6,845,290 B1 * 1/2005 Wunderlin ..... D06F 58/28 34/491

(Continued)

FOREIGN PATENT DOCUMENTS

GB 899955 A * 6/1962 ..... D06F 58/02
JP 6-98994 4/1994

(Continued)

OTHER PUBLICATIONS

PCT International Search Report dated Feb. 27, 2015 in corresponding International Patent Application No. PCT/KR2014/011646.

*Primary Examiner* — Stephen M Gravini
(74) *Attorney, Agent, or Firm* — Staas & Halsey LLP

(57) ABSTRACT

A clothing dryer includes a cabinet, a drying tub positioned at an inner side of the cabinet and configured to accommodate laundry, a plurality of moisture detecting sensor units provided at an inside the drying tub to detect moisture of laundry, and a sensor partition wall provided in between the plurality of moisture detecting sensor units to prevent a foreign substance from being stuck in between the plurality of moisture detecting sensor units. Through the structure as such, the accuracy in detecting dryness of laundry is enhanced, and an optimal controlling of the clothing dryer may be possible.

18 Claims, 14 Drawing Sheets

(56) References Cited

U.S. PATENT DOCUMENTS

| | | | | |
|---|---|---|---|---|
| 7,506,458 | B2 * | 3/2009 | Lee | D06F 58/04 34/601 |
| 7,762,007 | B2 * | 7/2010 | Guinibert | D06F 37/302 34/140 |
| 8,042,284 | B2 * | 10/2011 | Yoo | D06F 58/28 208/176 |
| 8,387,272 | B2 * | 3/2013 | Kim | D06F 58/28 165/166 |
| 8,387,274 | B2 * | 3/2013 | Ashrafzadeh | D06F 58/04 34/528 |
| 8,555,522 | B2 * | 10/2013 | Bellinger | D06F 58/28 219/506 |
| 8,561,320 | B2 * | 10/2013 | Geer | F26B 25/22 134/172 |
| 8,627,581 | B2 * | 1/2014 | Brown | D06F 58/02 34/603 |
| 8,997,377 | B2 * | 4/2015 | Kim | D06F 58/22 34/610 |
| 9,009,987 | B2 * | 4/2015 | Lee | F26B 21/06 34/443 |
| 2015/0152588 | A1 * | 6/2015 | Bae | D06F 58/28 34/82 |
| 2015/0153104 | A1 * | 6/2015 | Bae | D06F 58/04 34/108 |

FOREIGN PATENT DOCUMENTS

| | | | |
|---|---|---|---|
| KR | 10-2005-0119257 | 4/1994 | |
| KR | 10-2009-0112186 | 10/2009 | |
| KR | 10-2011-0087925 | 8/2011 | |
| KR | 10-2012-0065628 | 6/2012 | |
| KR | WO 2015084007 A1 * | 6/2015 | D06F 58/28 |

* cited by examiner

CLOTHING DRYER

CROSS-REFERENCE TO RELATED APPLICATIONS

This application claims the benefit of the Korean Patent Application No. 10-2013-0148645, filed on Dec. 2, 2013, in the Korean Intellectual Property Office, the disclosure of which is incorporated herein by reference.

BACKGROUND

1. Field

Embodiments of the present disclosure relate to a clothing dryer, or more particularly, a clothing dryer having an improved sensor structure.

2. Description of the Related Art

In general, a clothing dryer is apparatus configured to dry wet laundry that is inserted into a drying tub, by forcibly drafting heated air into an inside of the drying tub. The clothing dryer as such is similar to a drum washing machine with respect to an exterior appearance thereof, and is configured to dry laundry by forcibly circulating a wind that is heated through a heater and a blower fan into an inside the drying tub.

The clothing dryer includes a cabinet provided with a door at a front thereof, and a drying tub having the shape of a cylinder installed lengthways toward forward and backward directions inside the cabinet. In addition, the clothing dryer includes a duct, which is provided at an inside thereof with a heater to guide heated air to the drying tub after changing air into the heated air and with a blower fan configured to guide the heated air discharged from the drying tub to an outside.

The wet laundry at an inside the drying tub has moisture removed by the heated air that is dry, and the laundry is dried by the repeated circulation of the heated air.

The degree of dryness of the laundry is detected as a sensor is provided at an inside the clothing dryer. The sensor is provided in plurality of units, and by conducting the plurality of sensors by use of the moisture included in the wet laundry, the degree of dryness of the laundry is detected.

However, in a case when wet dust or a foreign substance is inserted into in between the sensors, the degree of dryness of the laundry may be difficult to precisely detect.

SUMMARY

Therefore, it is an aspect of the present disclosure to provide a clothing dryer having an improved structure so as to further precisely determine the degree of dryness of laundry.

Additional aspects of the disclosure will be set forth in part in the description which follows and, in part, will be apparent from the description, or may be learned by practice of the disclosure.

In accordance with one aspect of the present disclosure, a clothing dryer includes a cabinet, a drying tub, a plurality of moisture detecting sensor units, and a sensor partition wall. The drying tub may be positioned at an inner side of the cabinet and configured to accommodate laundry. The plurality of moisture detecting sensor units may be provided at an inside the drying tub to detect moisture of laundry. The sensor partition wall may be provided in between the plurality of moisture detecting sensor units to prevent a foreign substance from being stuck in between the plurality of moisture detecting sensor units.

The plurality of moisture detecting sensor units may each include a moisture detection sensing part exposed to an inside of the drying tub, and a fixing-bent part bent from one end portion of the moisture detection sensing part to allow the moisture detection sensing part to be fixed.

The clothing dryer may further include a filter member provided in between the drying tub and a duct communicating with the drying tub and through which air passed through an inside the drying tub is discharged, to filter a foreign substance. The moisture detecting sensor unit may be provided on the filter member.

The filter member may include a filter member body, an air discharging port, and a sensor mounting part. The filter member body may form an exterior appearance of the filter member. The air discharging port may be provided at the filter member body in the shape of a hollow hole such that the air passed through an inside the drying tub is discharged. The sensor mounting part may be provided on the filter member body and at which the moisture detecting sensor unit is disposed.

The sensor mounting part may include a first mounting part at which the moisture detection sensing part is mounted, and a second mounting part provided at one end portion of the first mounting part and at which the fixing-bent part is insertedly mounted.

The second mounting part may be open toward a lower side thereof such that accumulated moisture is discharged therethrough.

The sensor partition wall may include at least one moisture detection sensing part partition wall configured to divide the plurality of moisture detection sensing parts such that no foreign substance is stuck in between the plurality of moisture detection sensing parts.

The sensor partition wall may include at least one fixing part partition wall configured to divide the plurality of fixing-bent parts such that no foreign substance is stuck in between the plurality of fixing-bent parts.

The plurality of moisture detecting sensor units may include a pair of the moisture detecting sensor units provided in parallel to each other.

The plurality of fixing-bent parts may include a hook inclination surface inclined in a direction opposite to an insertion direction in which the fixing bent part is inserted into the second mounting part to prevent the plurality of fixing-bent parts from being separated at the time of when the plurality of fixing-bent parts are being inserted into the filter member.

The plurality of moisture detecting sensor units may further include a terminal connecting part bent from the other end portions of the moisture detection sensing parts to detect dryness of laundry and deliver the detected dryness of laundry to a control unit.

In accordance with another aspect of the present disclosure, a clothing dryer, includes a cabinet, a drying tub, a plurality of moisture detecting sensor units, and at least one sensor partition wall. The drying tub may be disposed at an inner side of the cabinet to accommodate laundry. The plurality of moisture detecting sensor units may include a plurality of moisture detection sensing parts exposed toward an inside of the drying tub, and a plurality of fixing-bent parts extendedly formed from the plurality of moisture detecting sensor units such that the plurality of moisture detecting sensor units are fixed, to detect dryness of laundry accommodated at an inside the drying tub. The at least one sensor partition wall may be configured to divide the plurality of moisture detecting sensor units from each other. The at least one sensor partition wall may include at least one moisture detection sensing part partition wall dividing the plurality of moisture detection sensing parts from each other, and at least one fixing-hook part partition wall dividing the plurality of fixing-bent parts from each other.

The clothing dryer may further include a first space at which the plurality of fixing-bent parts are mounted, and provided at one side thereof with a discharging opening to prevent moisture in the air inside the drying tub from being accumulated, wherein the at least one fixing-hook part partition wall is provided as to divide the first space.

The first space may be divided by the at least one fixing-hook part partition wall.

The plurality of fixing-bent parts may be disposed at the first spaces that are divided by the at least one fixing-hook part partition wall.

The clothing dryer may further include a filter member provided in between the drying tub and a duct communicating with the drying tub and through which air passed through an inside the drying tub is discharged, to filter a foreign substance. The plurality of moisture detecting sensor units may be disposed on the filter member.

The plurality of moisture detection sensing parts may be formed in a circumferential direction corresponding to a rotational direction of the drying tub.

The plurality of fixing-hook units may be disposed as to be spaced apart from each other with respect to left and right directions.

A clothing dryer in accordance with the present disclosure, with respect to detecting dryness of laundry, is capable of increasing accuracy and accordingly, is also capable of achieving the optimum control. In addition, a malfunction can be able to be prevented, and thus dryness efficiency can be enhanced.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
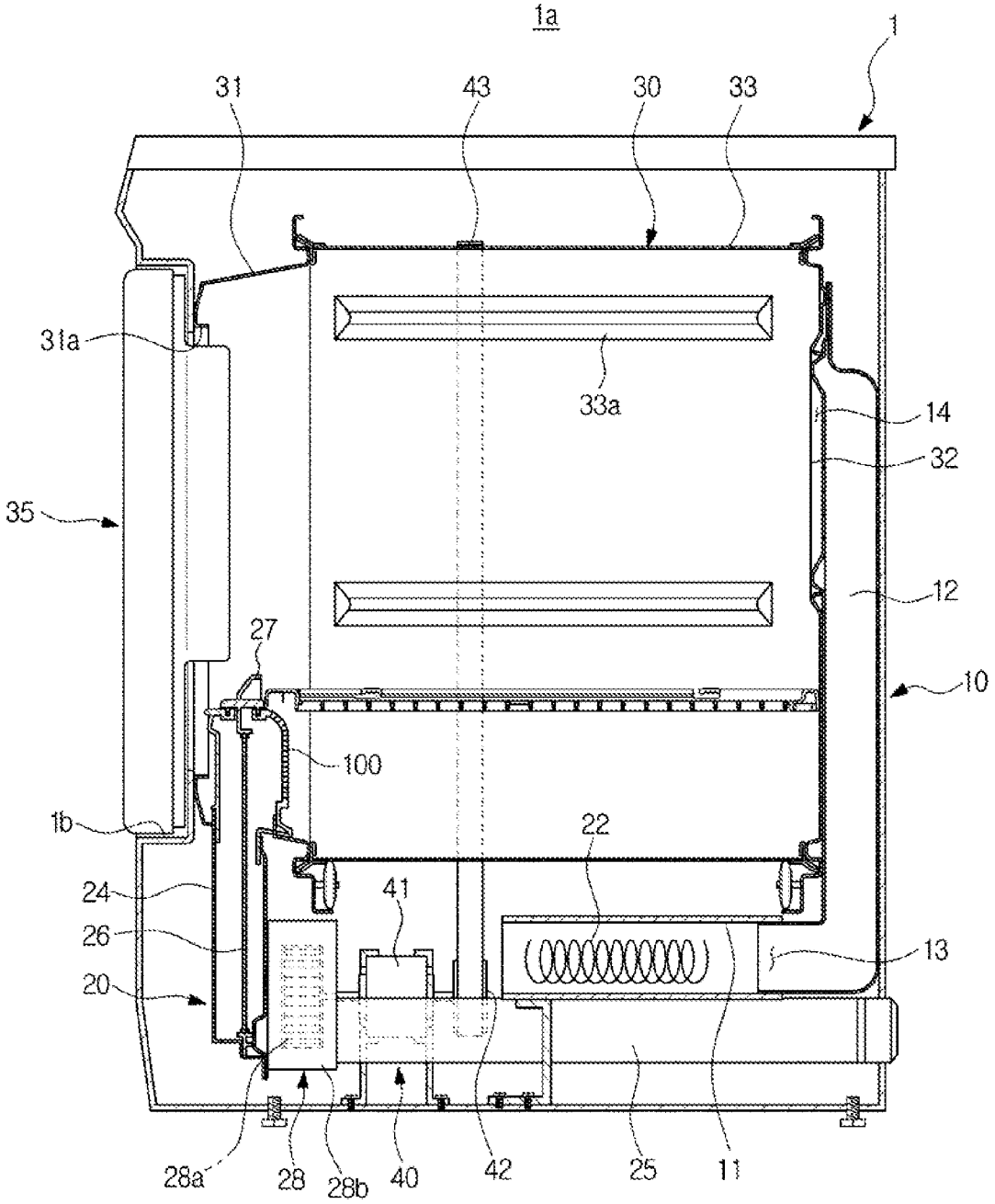
FIG. 1 is a cross-sectional view of a clothing dryer in accordance with one embodiment of the present disclosure.

Reference will now be made in detail to the embodiments of the present disclosure, examples of which are illustrated in the accompanying drawings, wherein like reference numerals refer to like elements throughout.

FIG. 1 is a cross-sectional view of a clothing dryer in accordance with one embodiment of the present disclosure.

As illustrated on FIG. 1, a clothing dryer 1*a* in accordance with one embodiment of the present disclosure includes a cabinet 1 forming an exterior appearance, a drying tub 30 rotatably installed at an inside the cabinet 1, a driving apparatus 40 configured to rotate the drying tub 30, a suction path 10, an exhaust path 20, and a blower apparatus 28 configured to circulate air to an inside the drying tub 30.

The drying tub 30 includes a cylindrical part 33 and a rear surface part 32. The cylindrical part 33 is structured in a cylindrical shape having a front surface and a rear surface thereof open. A front surface part 31 is coupled into a front surface of the cylindrical part 33, and the rear surface part 32 is installed at a rear surface of the cylindrical part 33.

Inlet ports 1*b* and 31*a* configured to insert laundry into or withdraw laundry from an inside the drying tub 30 are formed at a front surface of the cabinet 1 and the front surface part 31, and a door 35 configured to open/close the inlet ports 1*b* and 31*a* is installed at the front surface of the cabinet 1.

The driving apparatus 40 includes a driving motor 41 installed at a lower portion of an inner side of the cabinet 1, and a pulley 42 and a rotational belt 43 configured to deliver a driving force of the driving motor 41 to the drying tub 30. The rotational belt 43 is installed to be wound around the pulley 42 that is coupled to an outer surface of the drying tub 30 and a shaft of the driving motor 41.

The suction path 10 guides inlet of outside air to an inside the drying tub 30. The suction path 10 includes a first duct 12 provided with a suction port 13 configured to suction air from the drying tub 30 and a discharge port 14 configured to discharge air to the drying tub 30. The first duct 12 may be coupled to the rear surface part 32 of the drying tub 30. In addition, the suction path 10 may include a heating duct 11 installed at a lower portion of the drying tub 30 and coupled to the first duct 12. A heater 22 is installed in the heating duct 12 to heat air that is being suctioned.

The exhaust path 20 guides a discharging of air that is introduced into an inside the drying tub 30. The exhaust path 20 includes a front duct 24 configured to connect the in between a filter member 100 at a lower portion of the front unit 31 and an entry of the blower apparatus 28 installed at a lower portion of the drying tub 30, and a second duct 25 installed at a lower portion of the cabinet 1 such that an exit of the blower apparatus 28 is communicated with an outer side of a rear surface of the cabinet 1.

The blower apparatus 28 includes a blower apparatus housing 28*b*, and a blower fan 28*a* positioned at an inner side of the blower apparatus housing 28*b*. Moisture air at an inner side of the drying tub 30 may be discharged or moved toward the heater 22 by the driving of the blower fan 28*a*.

An inside filter member 26 is installed at the front duct 24 such that a foreign substance, such as dust or lint, included in heated air that is discharged from the drying tub 30 may be filtered. A handle part 27, which is configured such that the inside filter member 26 may be easily attached to/detached from the front duct 24 by use of a force of a user, may be provided at an upper side of the inside filter member 26.

The filter member 100 configured to guide air that is being suctioned into the inside filter member 26 may be provided around the inside filter member 26.

Figure 2:
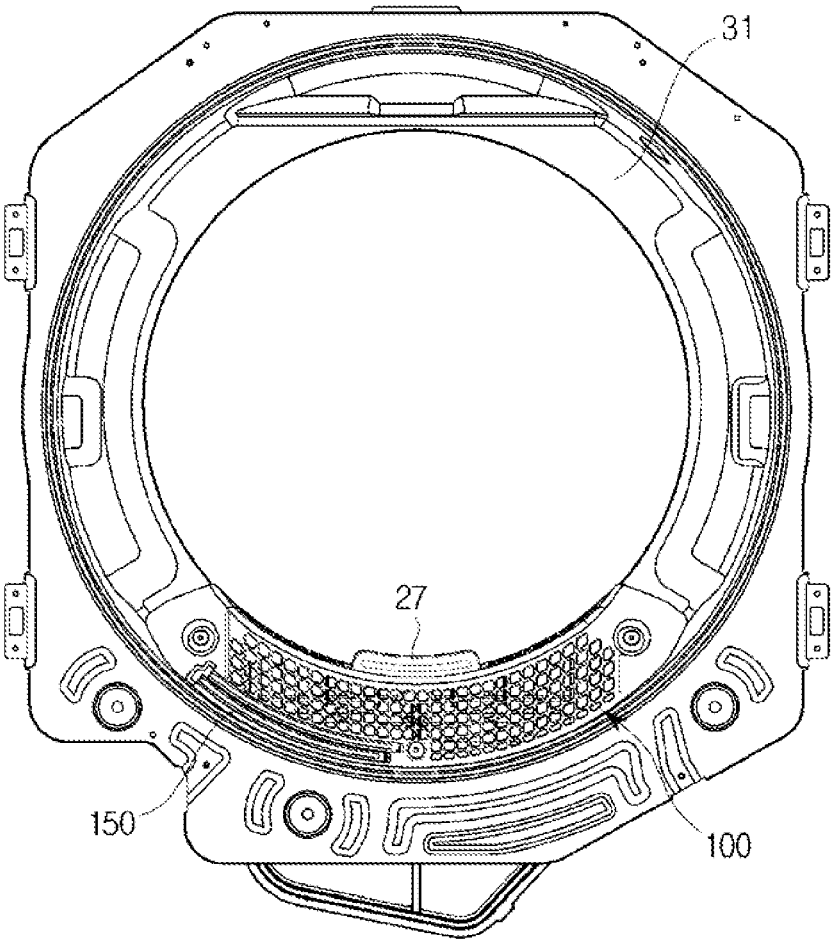
FIG. 2 is a drawing with respect to a front surface of the clothing dryer in accordance with one embodiment of the present disclosure.
Figure 3:
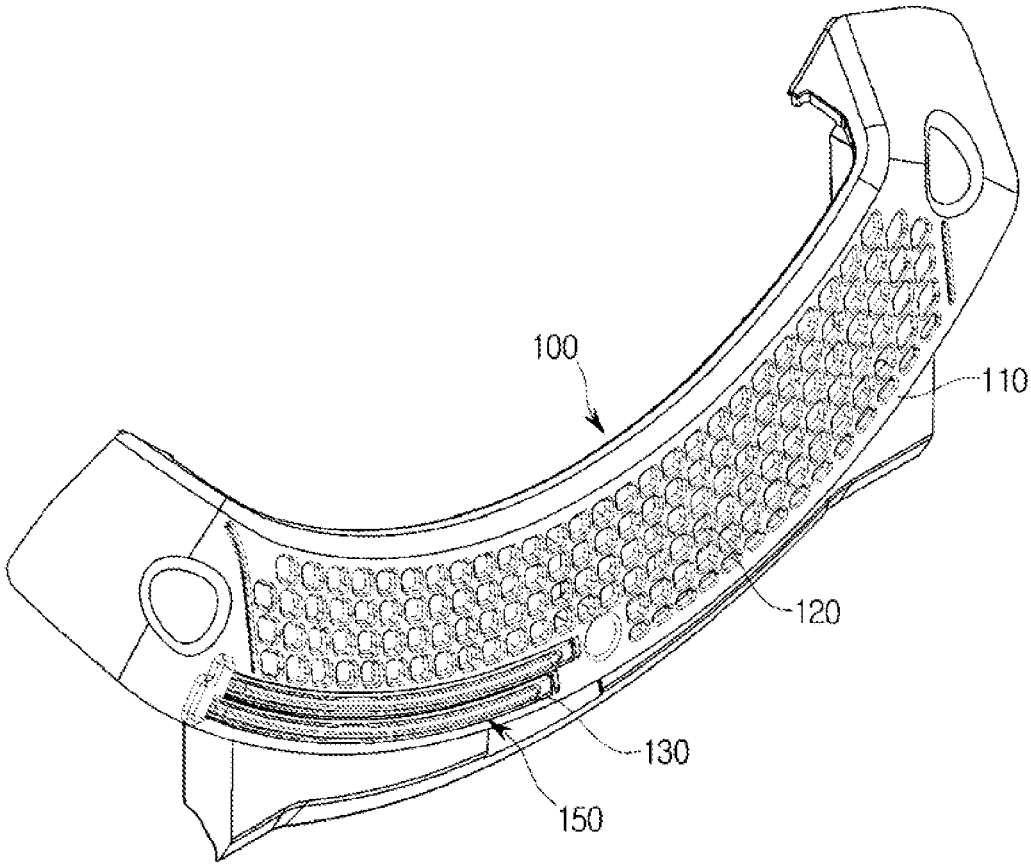
FIG. 3 is a drawing with respect to a filter member in accordance with one embodiment of the present disclosure.
Figure 4:
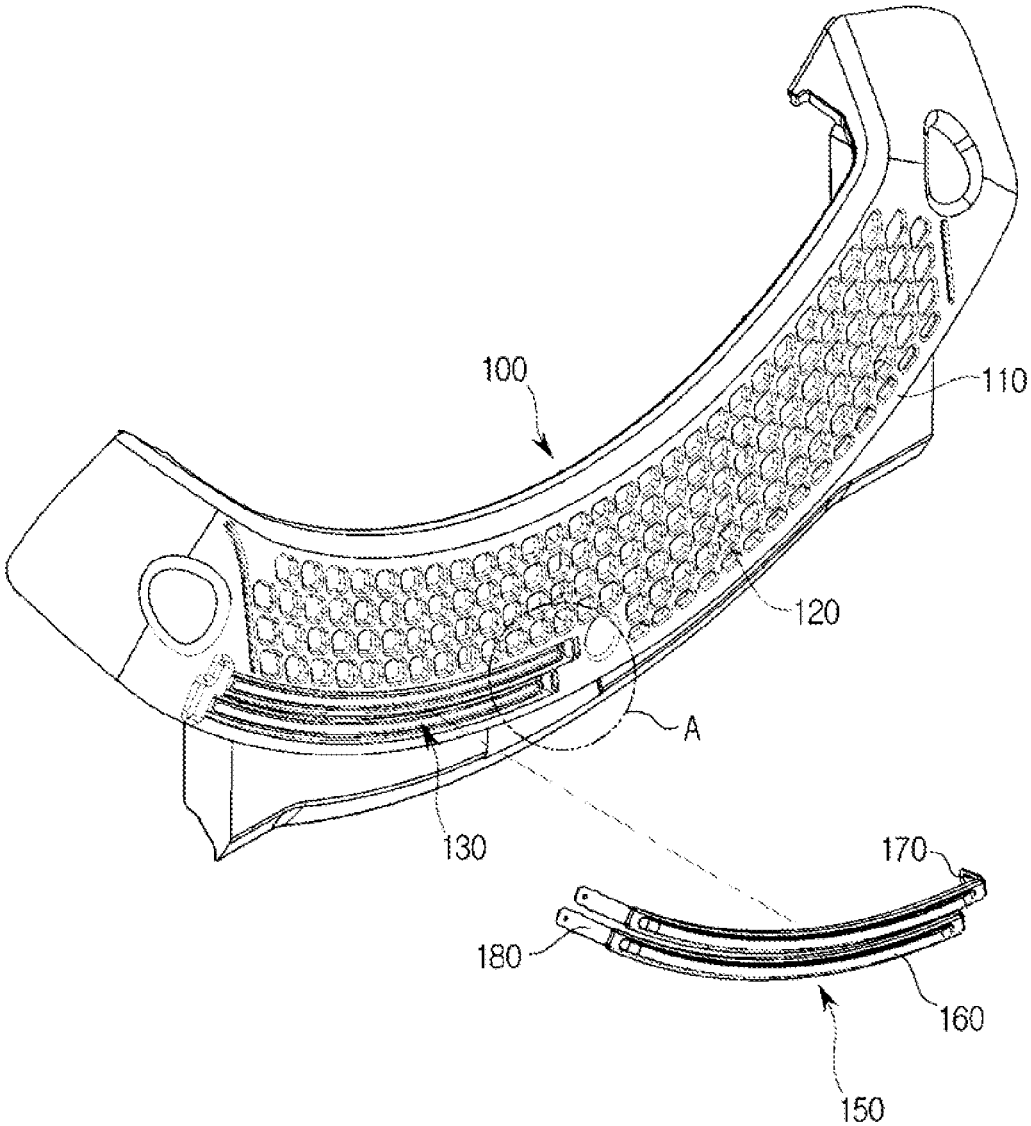
FIG. 4 is an exploded perspective view of the filter member and a moisture detecting sensor unit in accordance with one embodiment of the present disclosure.
Figure 5:
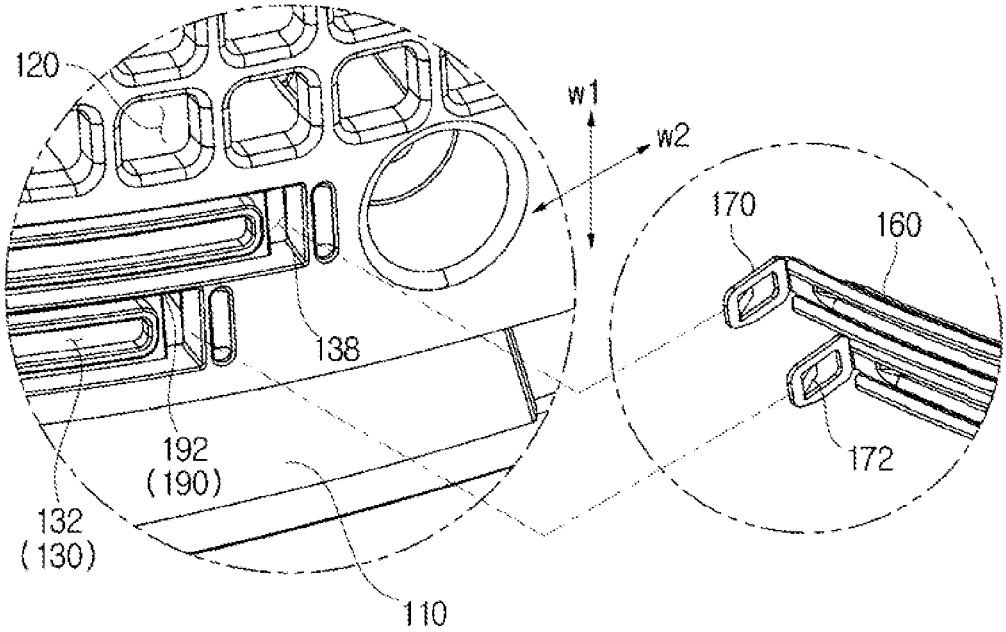
FIG. 5 is an enlarged drawing of 'A' of FIG. 4.

FIG. 2 is a drawing with respect to the front surface of the clothing dryer in accordance with one embodiment of the present disclosure, FIG. 3 is a drawing with respect to the filter member in accordance with one embodiment of the present disclosure, FIG. 4 is an exploded perspective view of the filter member and a moisture detecting sensor unit in accordance with one embodiment of the present disclosure, and FIG. 5 is an enlarged drawing of 'A' of FIG. 4.

The filter member 100 is provided as to prevent an inlet of a foreign substance or laundry to an inside the front duct 24, as dry air is discharged after passing through an inside the drying tub 30 and the laundry that is wet. The filter member 100 of one embodiment of the present disclosure is provided in between the front duct 24, which is communicated with the drying tub 30 and through which the air that is passed through an inside the drying tub 30 is discharged, and the drying tub 30 such that a foreign substance is filtered, but the configuration of the filter member 100 is not limited hereto.

The filter member 100 may include a filter member body 110, an air discharging part 120, and a sensor mounting part 130.

The filter member body 110 is disposed adjacent to the drying tub 30, and in one embodiment of the present disclosure, is provided to be disposed at a lower portion of a front surface of the drying tub 30. The air discharging part 120 is provided on the filter member body 110 such that air passed through the drying tub 30 may be discharged through the front duct 24.

The sensor mounting part 130 is provided on the filter member body 110, and may be provided adjacent to the air discharging part 120. However, the shape or the disposition of the sensor mounting part 130 is not limited hereto. With respect to the sensor mounting part 130, detailed descriptions will be provided hereinafter.

A moisture detecting sensor unit 150 is provided to detect the dryness of laundry disposed at an inside the drying tub 30. The disposition and the working principle of the moisture detecting sensor unit 150 are not limited, and in one embodiment of the present disclosure, the moisture detecting sensor unit 150 is formed to extend lengthways while provided to be mounted on the filter member 100. The moisture detecting sensor unit 150 may include at least one moisture detecting sensor unit 150.

The moisture detecting sensor unit 150 may include a moisture detection sensing part 160 and a fixing-bent part 170.

The moisture detection sensing part 160 may be provided in an exposed manner with respect to an inside the drying tub 30. The moisture detection sensing part 160 may be provided in plurality thereof, and in one embodiment of the present disclosure, a pair of the moisture detection sensing parts 160 is provided. The dryness is detected, as the laundry that is being rotated along with the rotation of the drying tub 30 is in contact with the moisture detection sensing part 160. In detail, when wet laundry is in contact with the pair of moisture detection sensing parts 160, conduction occurs in between the pair of moisture detection sensing parts 160, and by detecting the degree of the conduction, the dryness of the laundry is determined.

The plurality of moisture detection sensing parts 160 may be extendedly formed along a circumferential direction while corresponding to a rotational direction of the drying tub 30, and may be provided in parallel to each other so that no overlap occurs in between the plurality of moisture detection sensing parts 160.

One of the end portions of the plurality of moisture detection sensing parts 160 may be provided to not be overlapped with respect to a first direction W1', that is, an upper side and lower side direction. That is, one end portion of a certain one of the plurality of moisture detection sensing parts 160 may be provided not to be disposed in parallel to one end portion of a moisture detection sensing part 160 adjacent to the one moisture detection sensing part 160 in an upper side and lower side direction.

In other words, one of the end portions of the plurality of moisture detection sensing parts 160 are provided to be spaced apart from each other in a second direction 'W2', that is, a left side and right side direction, so that the moisture detection sensing part 160 disposed at a lower side is not affected by the moisture detection sensing part 160 disposed at an upper side.

The fixing-bent part 170 is provided in a bent manner from one end portion of the moisture detection sensing part 160 such that the moisture detection sensing part 160 is fixed. The fixing-bent part 170 may be provided in plurality thereof together with the moisture detection sensing parts 160, and in one embodiment of the present disclosure, a pair of the fixing-bent parts 170 is provided.

The fixing-bent part 170 may be provided to be conducted together with the moisture detection sensing part 160, or may be provided to be insulated.

Since the fixing-bent part 170 is provided at one end portion of the moisture detecting sensor unit 150, a malfunction may occur at the moisture detecting sensor unit 150 as moisture is accumulated, or may reduce lifespan of the moisture detecting sensor unit 150, and thus the fixing-bent part 170 may be disposed at a first space 140, which is an open space to be ventilated.

The first space 140 is provided with a discharging opening 136 such that at least one side of the first space 140 may be open, and in one embodiment of the present disclosure, the first space 140 is provided to be open to a lower side, so that the water that may be generated from accumulated moisture may be discharged.

The plurality of fixing-bent parts 170 may be provided to be spaced apart from each other with respect to the second direction 'W2', that is, the left and right direction. Through the structure as the above, the fixing-bent part 170 disposed at a lower side may be provided not to be affected by the fixing-bent part 170 disposed at an upper side.

The sensor mounting part 130 may be included in the filter member 100 such that the moisture detecting sensor unit 150 is disposed.

The sensor mounting part 130 may include a first mounting part 132 and a second mounting part 134.

The first mounting part 132 is provided to correspond to the moisture detection sensing part 160, so that the moisture detection sensing part 160 is mounted on the first mounting part 130. That is, the first mounting part 132 is provided in a concave manner with respect to a surface of the filter member 100 while corresponding to the shape of the moisture detection sensing part 160, and is formed in a concave manner in lengthways direction while corresponding to the moisture detection sensing part 160 that is formed lengthways.

The first mounting part 132 may be extendedly formed along a circumferential direction according to a rotational direction of the drying tub 30, and may be provided in a parallel manner so that no overlapping may be occurred. The moisture detecting sensor unit 150 may be provided in plurality thereof, and thus the first mounting part 132 may also be provided in plurality thereof.

The second mounting part 134 is provided as to correspond to the fixing-bent part 170, so that the fixing-bent part 170 may be mounted. The second mounting part 134 is provided with an identical structure as the first space 140, and is identical to the first space 140 with respect to descriptions. The fixing-bent part 170 may be provided in plurality, and thus the second mounting part 134 may also be provided in plurality thereof.

The plurality of second mounting parts 134 each is provided to accommodate each of the plurality of the fixing-bent parts 170, and may be divided by a fixing-bent part partition wall 194, which is to be described later. In addition, the plurality of second mounting parts 134 may be disposed in a parallel manner in the second direction 'W2' while corresponding to the plurality of the fixing-bent parts 170, which is spaced apart with respect to each other in the second direction 'W2', that is, the left and right directions.

The moisture detecting sensor unit 150 may further include a terminal connecting part 180.

The terminal connecting part 180 is connected to a terminal that is connected to a control unit, and the terminal connecting part 180 is provided to transmit the dryness of the laundry that is detected from the moisture detecting sensor unit 150 to the control unit. The shape of the terminal connecting part 180 is not limited hereto, but in one embodiment of the present disclosure, the terminal connecting part 180 is provided with the shape being extendedly formed after being bent from the moisture detection sensing part 160.

Figure 6:
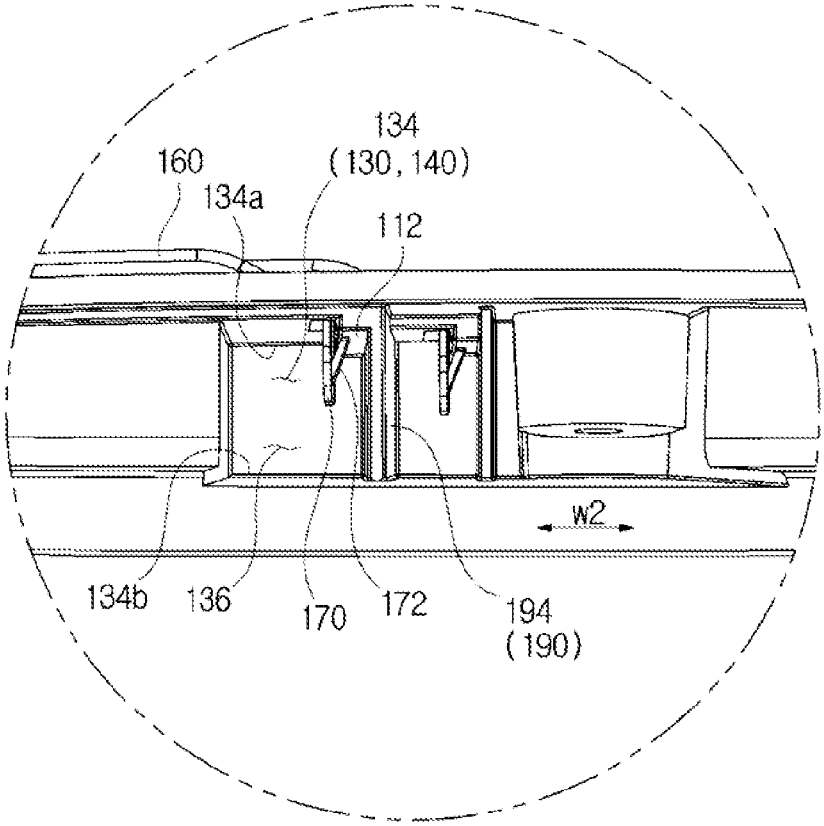
FIG. 6 is a drawing with respect to a moisture detecting sensor unit in accordance with one embodiment of the present disclosure.

FIG. 5 is an enlarged drawing of 'A' of FIG. 4, and FIG. 6 is a drawing with respect to the moisture detecting sensor unit in accordance with one embodiment of the present disclosure.

A sensor partition wall 190 is provided to divide the plurality of moisture detecting sensor units 150. By dividing the plurality of moisture detecting sensor units 150, a malfunction that may occur caused by lint having moisture or a foreign subject being stuck in between the plurality of moisture detecting sensor units 150 may be prevented, and the plurality of moisture detecting sensor units 150 is provided such that a more precise detection may be performed.

The sensor partition wall 190 may include a sensing part partition wall 192 and the fixing-bent part partition wall 194.

The sensing part partition wall 192 is provided to divide the plurality of the moisture detection sensing parts 160. The sensing part partition wall 192 may be provided in between the plurality of first mounting parts 132.

The sensing part partition wall 192 is provided such that a malfunction, which may occur as a lint having moisture or a foreign subject is being stuck in between the plurality of moisture detection sensing parts 160 that is mounted at the first mounting part 132, may be prevented. The sensing part partition wall 192 is formed at the first mounting part 132 lengthways of the first mounting part 132, and is provided in a protruded manner with respect to the first mounting part 132. The shape of the sensing part partition wall 192 is not limited hereto, and is sufficient to be provided with a structure capable of dividing the plurality of moisture detection sensing parts 160 that is mounted at the first mounting part 132.

The fixing-bent part partition wall 194 is provided as to divide the plurality of the fixing-bent parts 170. The fixing-bent part partition wall 194 may be provided in between the plurality of second mounting part 134.

The fixing-bent part partition wall 194 is provided such that a malfunction, which may occur because of lint having moisture or a foreign subject stuck in between the plurality of the fixing-bent parts 170 that is settled at the second mounting part 134, may be prevented. The fixing-bent part partition wall 194 is provided so as to divide the in between of the plurality of the fixing-bent parts 170.

The fixing-bent part partition wall 194 may be provided so as to divide the plurality of the fixing-bent parts 170 while extendedly formed longer than the length of the fixing bent part 170 from a first surface 134*a* at which an input hole 138 allowing the fixing-bent part 170 to be inserted into the second mounting part 134 therethrough. In one embodiment of the present disclosure, the fixing-bent part partition wall 194 is formed to be extended to reach from the first surface 134*a* to a second surface 134*b*, which faces the first surface 134*a*.

Referring to FIG. 5, the moisture detection sensing part 160 is provided so as to be mounted at the first mounting part 132, and the fixing-bent part 170 is provided so as to be mounted at the second mounting part 134 while inserted into the insertion hole 138.

The fixing-bent part 170 may include a hook inclination surface 172.

The hook inclination surface 172 is provided to be hooked by a hooking step 112 provided at the filter member 100, as the hook inclination surface 172 is formed in an inclined manner in an opposite direction with respect to an insertion direction in which the fixing-bent part 170 is inserted into the second mounting part 134.

Through the structure as such, the fixing-bent part 170 is provided to be prevented from being easily separated from the second mounting part 134. That is, as the fixing-bent part 170 is mounted at the second mounting part 134 through the insertion hole, the hook inclination surface 172 is hooked at the hooking threshold 112, so that the fixing-bent part 170 is prevented from being easily separated from the second mounting part 134.

Figure 7:
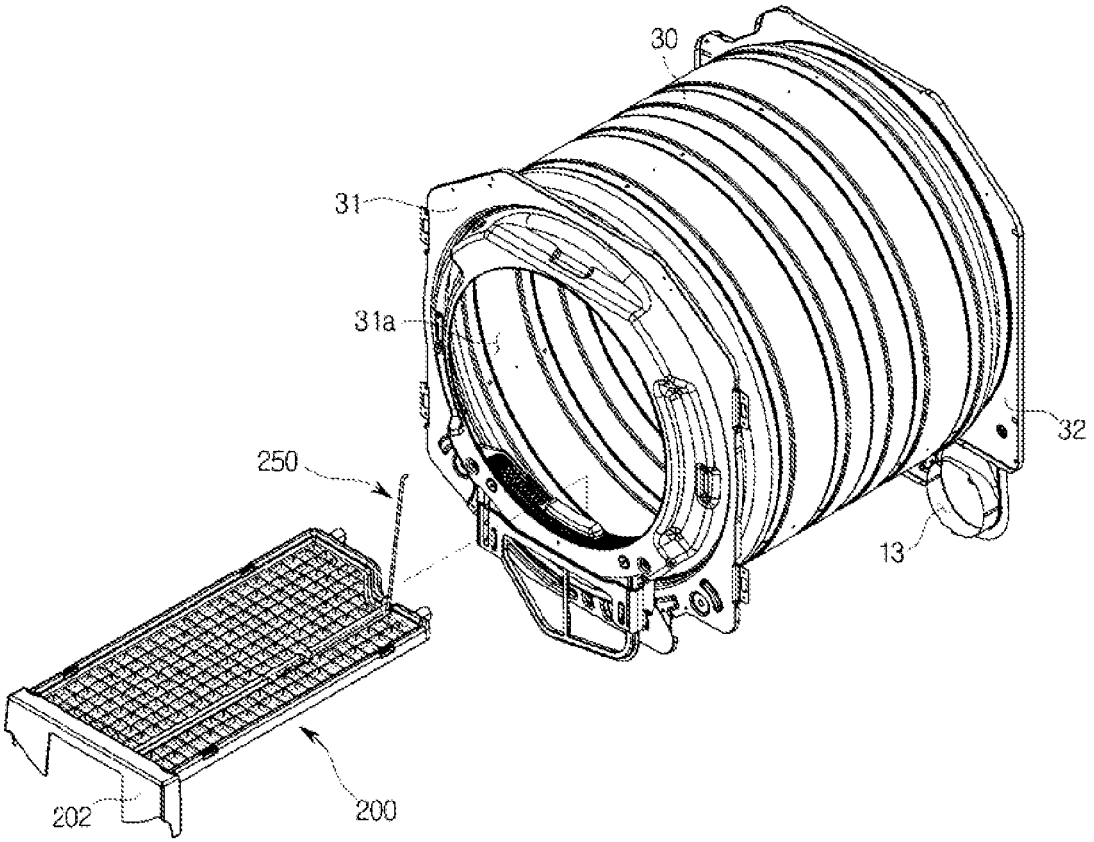
FIGS. 7 and 8 are drawings with respect to a disposition of a drying shelf in accordance with one embodiment of the present disclosure.

FIG. 7 is a drawing with respect to a disposition of a drying shelf in accordance with one embodiment of the present disclosure.

The drying tub 30 includes the cylindrical part 33 and the rear surface part 32. The cylindrical part 33 is structured in a cylindrical shape having a front surface and a rear surface thereof open. The front surface part 31 is coupled to a front surface of the cylindrical part 33, and the rear surface part 32 is installed at a rear surface of the cylindrical part 33.

The drying tub 30 is provided as to be rotated. The cylindrical part 33 and the rear surface part 32 may be provided to be rotated together, and in one embodiment of the present disclosure, the cylindrical part 33 is rotatably provided while the rear surface part 32 is fixedly provided.

At an inside the cylindrical part 33, a plurality of lifters 33*a* may be disposed along a circumferential direction of the cylindrical part 33. The lifter 33*a* is configured to effectively dry laundry by ascending and descending the laundry.

A drying shelf 200 is detachably installed at an inside the drying tub 30. A front end of the drying shelf 200 is supported by the filter member 100, and a rear end of the drying shelf 200 may be supported by the rear surface part 32, which is the rear surface of the drying tub 30. As the both front end and rear end of the drying shelf 200 are supported, even in a case when heavy laundry is placed on the drying shelf 200, the drying shelf 200 may be able to stably maintain a state in which the laundry is supported.

Figure 8:
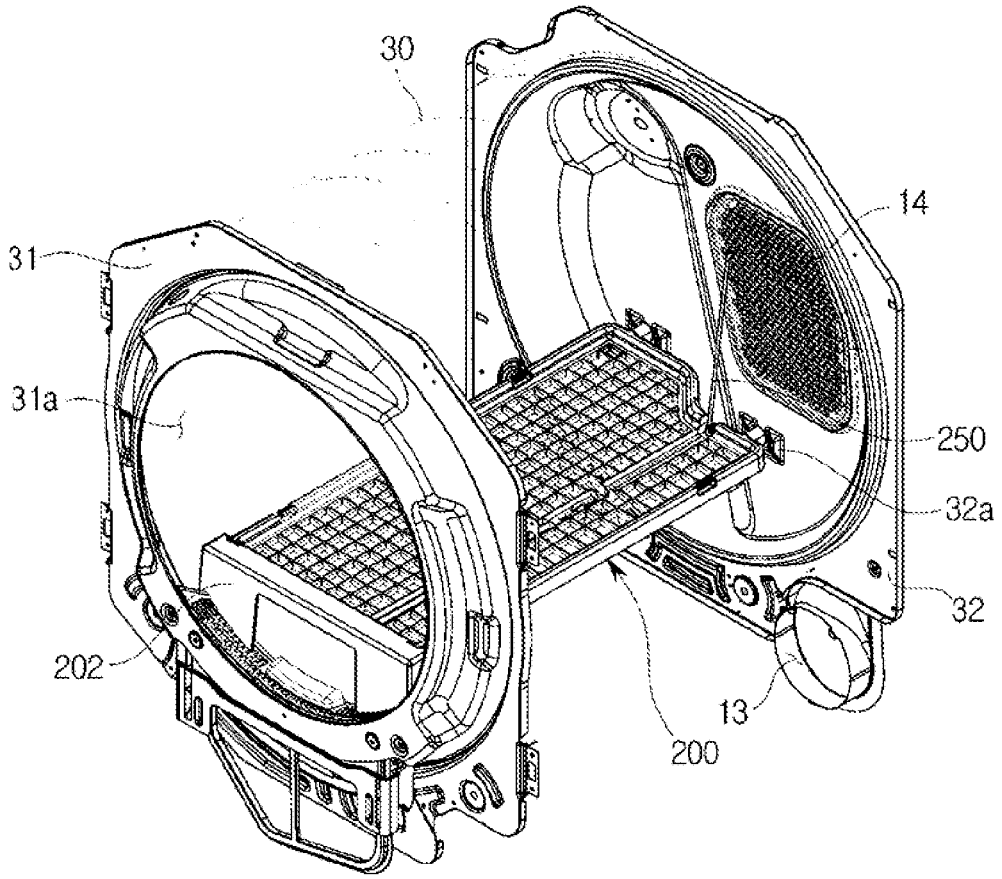
Figure 9:
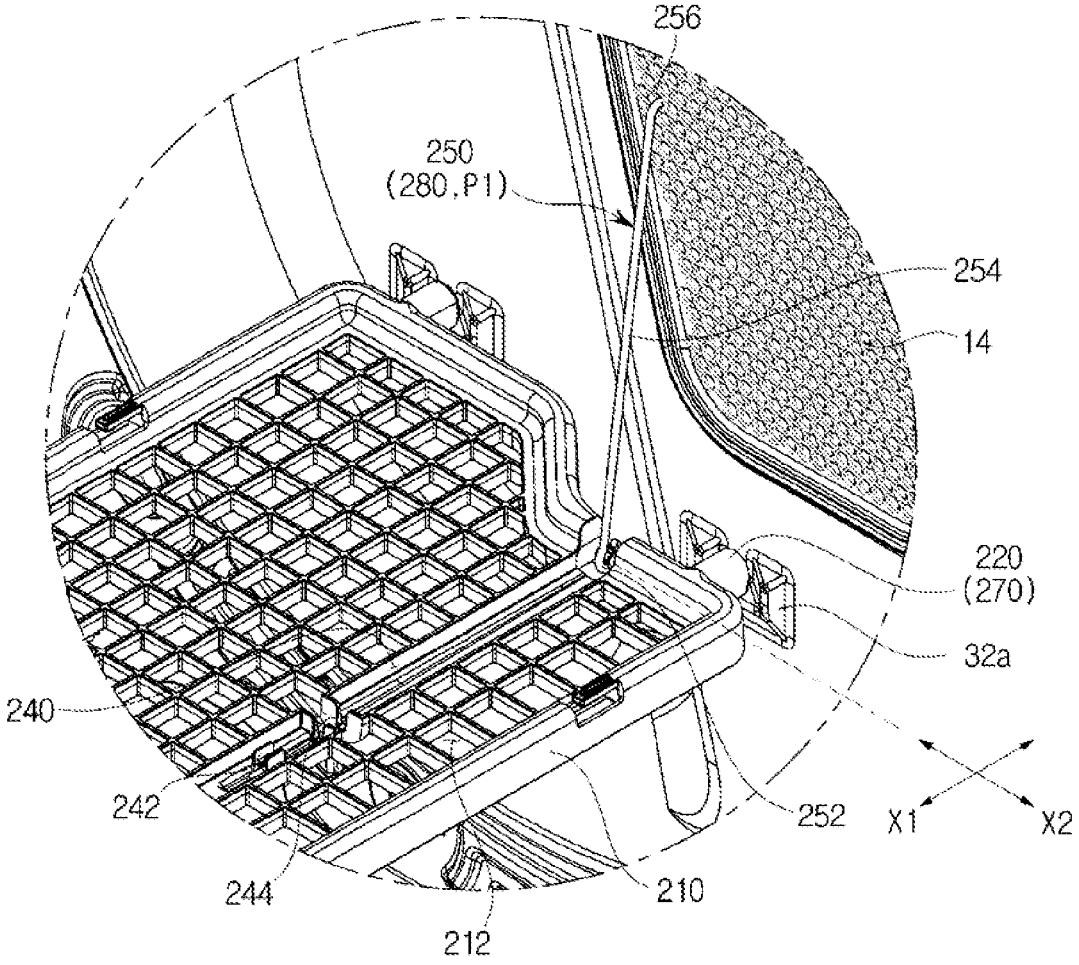
FIG. 9 is a drawing showing a supporting member in a first position in accordance with one embodiment of the present disclosure.
Figure 10:
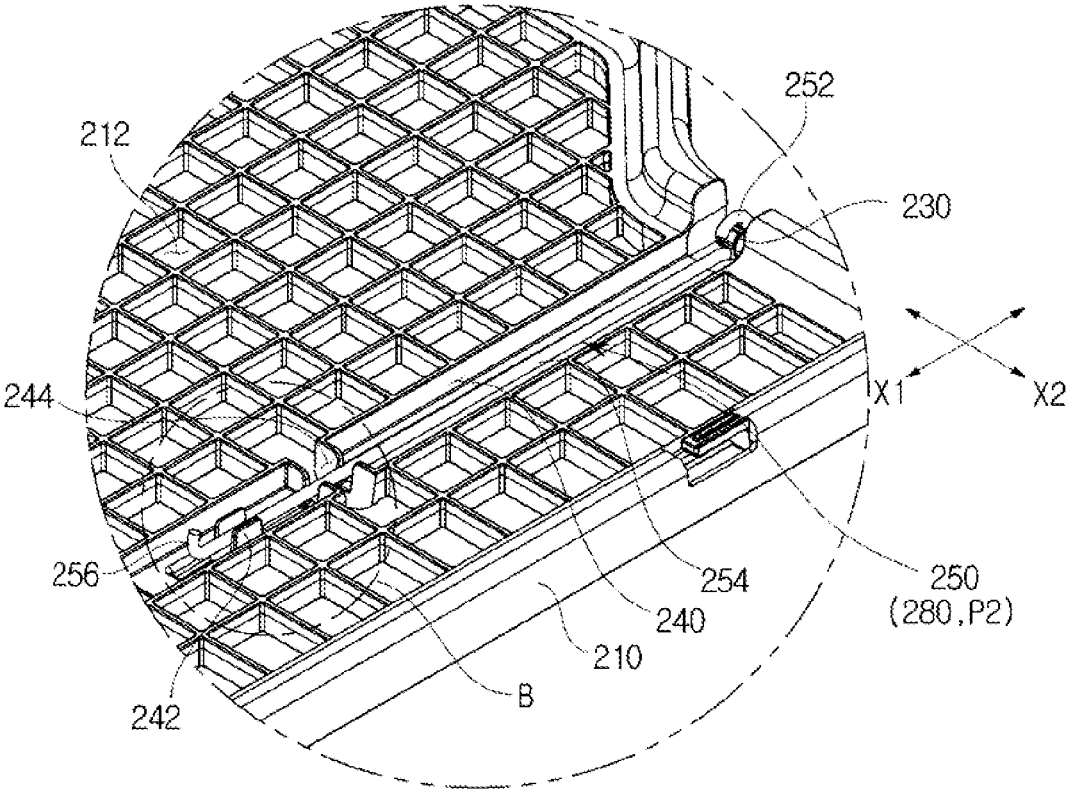
FIG. 10 is a drawing showing the supporting member in a second position in accordance with one embodiment of the present disclosure.
Figure 11:
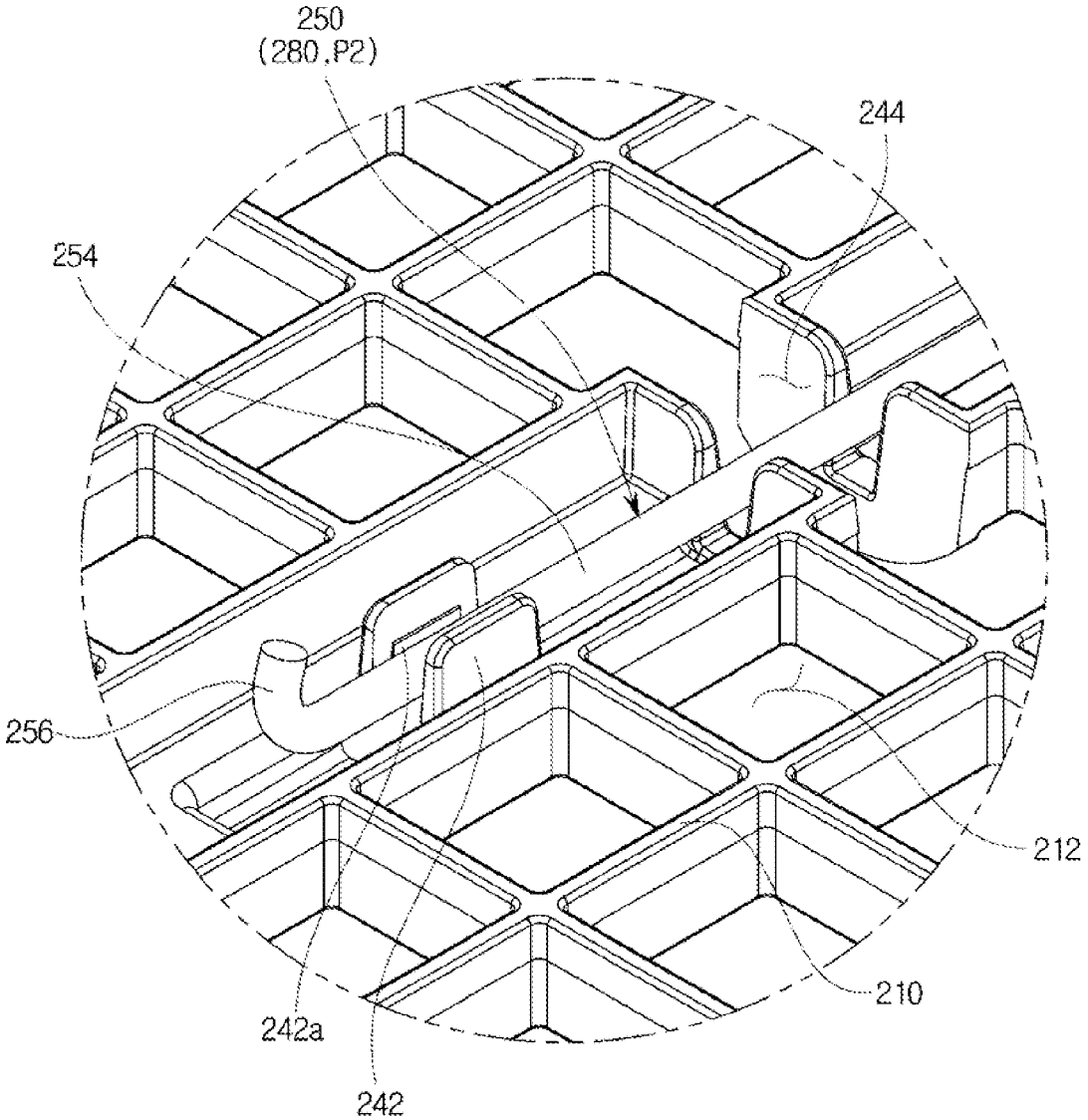
FIG. 11 is an enlarged drawing of 'B' of FIG. 10.
Figure 12:
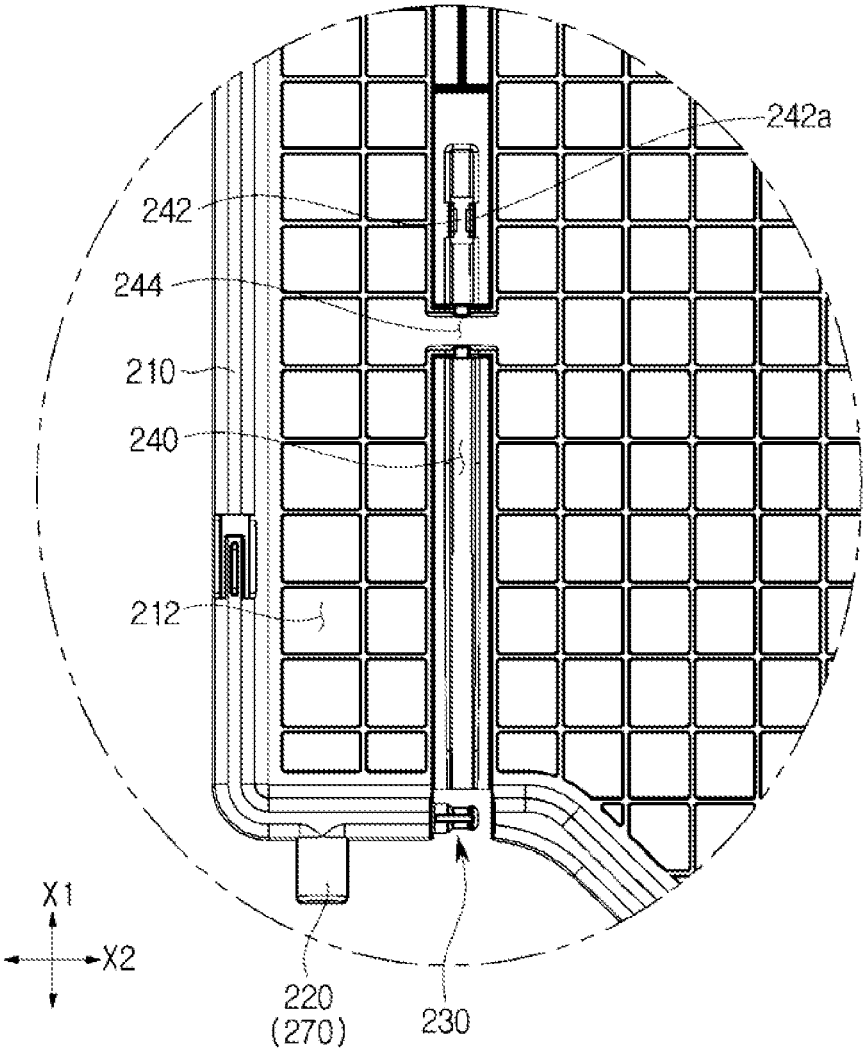
FIG. 12 is an enlarged drawing of a portion of the drying shelf in accordance with one embodiment of the present disclosure.

FIG. 8 is a drawing with respect to a disposition of a drying shelf in accordance with one embodiment of the present disclosure, FIG. 9 is a drawing showing a supporting member in a first position in accordance with one embodiment of the present disclosure, FIG. 10 is a drawing showing the supporting member in a second position in accordance with one embodiment of the present disclosure. FIG. 11 is an enlarged drawing of 'B' of FIG. 10, and FIG. 12 is an enlarged drawing of a portion of the drying shelf in accordance with one embodiment of the present disclosure.

The front end of the drying shelf 200 is supported by the filter member 100, and the rear end of the drying shelf 200 is supported by the rear surface part 32. The filter member 100 is provided with an upper portion thereof having a concave shape according to the inlet ports 1*b* and 31*a*, and thus a mounting rib 202 corresponding to the shape of the upper portion of the filter member 100 may be provided at the front end of the drying shelf 200 as to mount the front end of the drying shelf 200 at the upper portion of the filter member 100.

The drying shelf 200 may include a base 210, a propping protrusion 220, and a hooking member 230.

The base 210 is provided such that a subject to be dried is placed on the base 210, and may have a plurality of hollow holes 212 to discharge water being discharged from the subject. The subject is not dried by ascending and descending while being disposed on the cylindrical part 33 through a rotation of the cylindrical part 33, but dried while being placed on the base 210 of the drying shelf and, so there is a need that the drying shelf 200 is maintained in a predetermined position. For the above, the base 210 may be provided as to maintain a level at an inside the drying tub 30. The shape of the base 210 is not limited hereto, and may be provided so as to correspond to the shape of an inside the drying tub 30.

The propping protrusion 220 is configured to protrude from the base 210 to support a rear end of the drying shelf 200. In detail, the propping protrusion 220 is provided as to protrudedly form toward the rear surface part 32 of the drying tub 30 from the base 210. The propping protrusion 220 may be provided in at least one unit thereof, and in one embodiment of the present disclosure, a pair of the propping protrusions 220 is provided to support the both sides of the rear end of the drying shelf 200.

A protrusion mounting part 32*a* formed in the shape of a convex toward an inner side of the drying tub 30 may be provided such that the propping protrusion 220 may be mounted on the protrusion mounting part. The protrusion mounting part 32*a* may be provided in at least one unit thereof as to correspond to the at least one propping protrusion 220, and in one embodiment of the present disclosure, a pair of the protrusion mounting parts 32*a* may be provided.

The hooking member 230 is provided such that a supporting member 250, which will be described later, may be rotated with respect to the drying shelf 200. The shape of the hooking member 230 is not limited hereto as long as a rotating part 252 of the supporting member 250, which will be described layer, is rotated.

Assuming that the lengthways direction of the drying shelf 200 is referred to as a first direction 'x1', the hooking member 230 may be protrudedly formed from the base 210 toward a second direction 'x2' that is perpendicular to the first direction 'x1'. In addition, the hooking member 230 is provided to be spaced apart by a certain distance from the base 210 with respect to an extension line of the second direction 'x2' of the hooking member 230, such that the supporting member 250 may be able to be separated from the hooking member 230.

The supporting member 250 is configured to support the drying shelf 200 such that the drying shelf 200 mounted at an inside the drying tub 30 is not separated. The supporting member 250 is rotatably provided so as to be rotated with respect to the drying shelf 200 as to support the drying shelf 200, or is provided to be mounted on the drying shelf 200.

In detail, the supporting member 250 is provided to be moved to a first position P1' at which one side of the drying shelf 200 is being supported at an inside the cabinet 1, and is also provided to be moved to a second position 'P2' at which the supporting member 250 is mounted at the drying shelf 200.

The supporting member 250 is rotatably provided so as to be rotated with respect to the drying shelf 200, and is configured to support the drying shelf 200 by rotating the supporting member 250 to the first position 'P1' in a case when the drying shelf 200 is being disposed and used at an inside the drying tub 30 and also is configured to be mounted at the drying shelf 200 by rotating the supporting member 250 to the second position 'P2' in a case when the drying shelf 200 is stored without being used.

The supporting member 250 may include the rotating part 252 and a supporting fixture 254.

The rotating part 252 allows the supporting member 250 to be rotated at one side of the drying shelf 200 between the first position 'P1' and the second position 'P2'. In one embodiment of the present disclosure, the rotating part 252 is formed in the shape of a hook. The supporting member 250 may be provided to be rotated between the first position 'P1' and to the second position 'P2' while hinge-coupled to the drying shelf 200 through the rotating part 252. By use of the rotating part 252, the supporting member 250 is provided to be rotated while having the second direction 'x2' as a center of rotation.

The supporting fixture 254 is provided to support the drying shelf 200 while extendedly formed from the rotating part 252. In detail, while extendedly formed from the rotating part 252 and provided to be supported at the rear surface part 32 of the drying tub 30, the supporting fixture 254 is configured to support the drying shelf 200. The supporting fixture 254 is provided to support the drying shelf 200, a well as a subject to be dried being placed on the drying shelf 200, so that the drying shelf 200 is not separated. However, since the drying shelf 200 may be separated toward upper and lower directions, as well as left and right directions, the supporting fixture 254 is formed by having the shape of a solid bar to maintain a position of the drying shelf 200.

The support member 250 may further include a fixing-hooking part 256.

The fixing-hooking part 256 is provided at one end portion of the supporting fixture 254 to be fixed at a rear surface of the drying tub 30. In detail, the fixing-hooking part 256 is provided to be extendedly formed while bent from one end portion of the supporting fixture 254.

The fixing-hooking part 256 is provided to be hooked at a rear surface of the drying tub 30, and is configured to support the drying shelf 200 to prevent the drying shelf 200 from being separated by the rotation or vibration of the drying tub 30. The structure corresponding to the fixing-hooking part 256 is not limited hereto, but in one embodiment of the present disclosure, the fixing-hooking part is provided to be hooked at a discharging port 14 through which dry air is introduced to an inside the drying tub 30.

The drying shelf 30 may include a mounting groove 240 and a fixing protrusion 242.

The mounting groove 240 is referred to as a structure that is provided such that the supporting member 250 is disposed at the drying shelf 200 in a case when the supporting member 250 is disposed at the second position P2', that is, in a case when the supporting member 250 is mounted at the drying shelf 200, and the mounting groove 240 may be formed in a concave manner when compared to a surface of the drying shelf 200 adjacent to the mounting groove 240. The mounting groove 240 is formed in lengthways by corresponding to the length of the supporting member 250, and may be formed in a concave manner to the degree that the supporting member 250 is not being protruded to an outside in a case when the supporting member 250 is disposed to the second position P2'.

The fixing protrusion 242 is provided to fix the supporting member 250 that is mounted at the mounting groove 240. As a pair of the fixing protrusions 242 is provided, the pair of fixing protrusions 242 is provided to support the both sides of the supporting member 250. In detail, the pair of fixing protrusions 242 is provided to be spaced apart when the supporting member 250 is being inserted into and also to return to an original position again when the supporting member 250 is being separated, as the pair of fixing protrusions 242 is provided to have elasticity. The pair of fixing protrusions 242 is provided with a separation preventing bump 242*a* protrudedly formed toward an inner side of the pair of fixing protrusions 242 as to prevent the supporting member 250 fixed by the pair of fixing protrusions 242 from being easily separated.

A spacing groove 244 may be provided at the mounting groove 240, which is formed in lengthways of the supporting member 250 such that the supporting member 250 may be mounted, in a perpendicular direction with respect to the lengthways of the mounting groove 240. The spacing groove 244 is provided to have a wider width with respect to the mounting groove 240 adjacent to the spacing groove 244, and the width of the distant groove 244 is formed wider than the adjacent mounting groove 240 such that a user may be able to hold the supporting member 250 by inserting a finger in a case when the user separates the supporting member 250 from the mounting groove 240.

Figure 13:
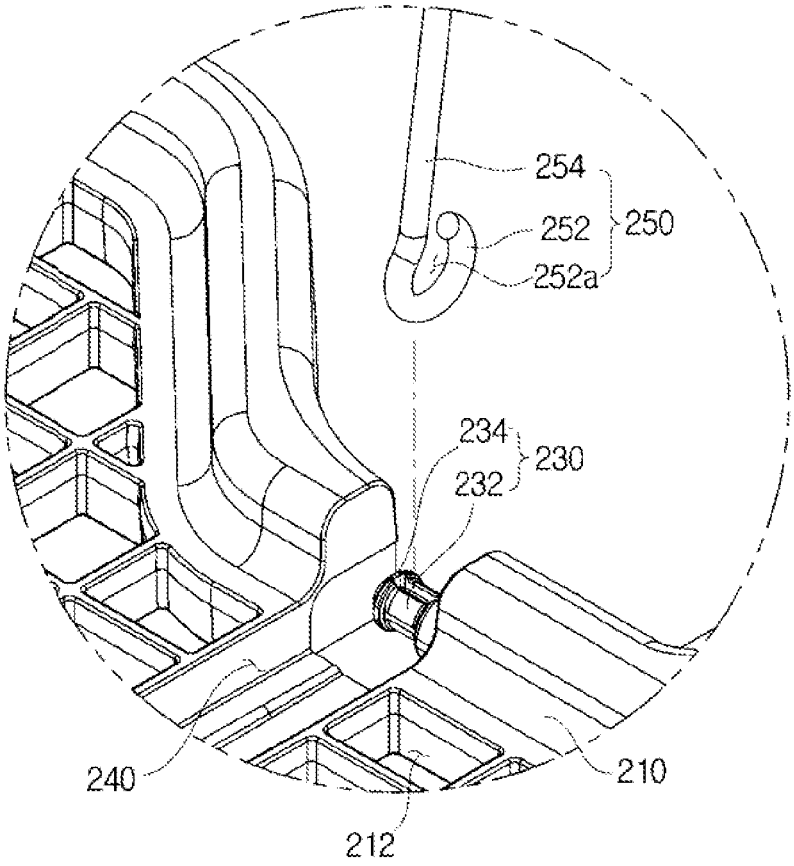
FIG. 13 is a drawing with respect to a coupling of the drying shelf and the supporting member in accordance with one embodiment of the present disclosure.
Figure 14:
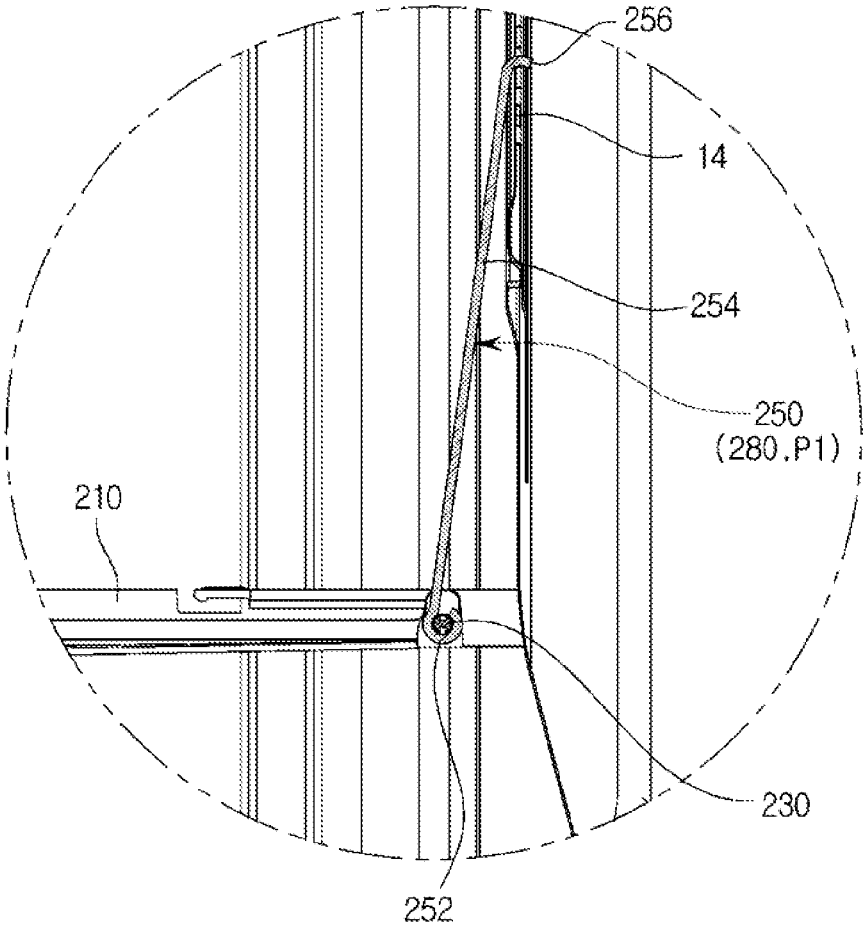
FIG. 14 is a cross-sectional view with respect to a coupling of the drying shelf and the supporting member in accordance with one embodiment of the present disclosure.

FIG. 13 is a drawing with respect to a coupling of the drying shelf and the supporting member in accordance with one embodiment of the present disclosure, and FIG. 14 is a cross-sectional view with respect to a coupling of the drying shelf and the supporting member in accordance with one embodiment of the present disclosure.

The supporting member 250 is provided to be attached to/detached from the hooking member 230 as an insertion hole 252*a* is provided at the rotating part 252.

A rotation mounting part 232 formed in a concave manner with respect to an adjacent surface is provided at a mid portion of the hooking member 230, so that the rotating part 252 may be mounted on the rotation mounting part 232. In addition, the rotating part 252 may be provided not to be easily separated from the hooking member 239, as a rotation insertion part 234 having a large diameter thereof formed than the rotation mounting part 232 is provided at one end portion of the hooking member 230.

In a case when the supporting member 250 is disposed at the first position 'P1', the supporting member 250 may be provided to form an obtuse angle with respect to the base 210. As the supporting member 250 and the base 210 are disposed in an obtuse angle, the center of gravity of the drying shelf 200 and of the subject to be dried being placed at the drying shelf 200 may be made to be positioned toward a rear side of the base 210 even in a case when the propping protrusion 220 is separated from the mounting protrusion, and thus the drying shelf 200 may be stably supported.

Hereinafter, descriptions with respect to a clothing dryer in accordance with one aspect of the present disclosure will be provided from another perspective.

The clothing dryer includes the cabinet 1, the drying tub 30 positioned at an inner side of the cabinet 1, the drying shelf 200 disposed at an inside the drying tub 30, and a main supporting member 270 and an auxiliary supporting member 280 configured to support the drying shelf 200.

The descriptions with respect to the overlapped components will be omitted.

The main supporting member 270 and the auxiliary supporting member 280 are provided with similar structures as the propping protrusion 220 and the supporting member 250, respectively. The main supporting member 270 is provided in at least one unit thereof while protrudedly provided from a rear surface of the base 210 to be placed at the rear surface part 32 of the drying tub 30. The auxiliary supporting member 280 is provided with one end portion thereof rotatably provided at the drying shelf 200, while the other end portion thereof is provided to be supported at the rear surface part 32.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A clothing dryer, comprising:

a cabinet;

a drying tub positioned at an inner side of the cabinet and configured to accommodate laundry;

a plurality of moisture detecting sensor units provided at an inside the drying tub to detect moisture of laundry; and a sensor partition wall provided in between the plurality of moisture detecting sensor units to prevent a foreign substance from being stuck in between the plurality of moisture detecting sensor units.

2. The clothing dryer of claim 1, wherein:

the plurality of moisture detecting sensor units each comprises a moisture detection sensing part exposed to an inside of the drying tub; and a fixing-bent part bent from one end portion of the moisture detection sensing part to fix the moisture detection sensing part.

3. The clothing dryer of claim 2, further comprising:

a filter member provided in between the drying tub and a duct communicating with the drying tub and through which air passed through an inside the drying tub is discharged, to filter a foreign substance, wherein the moisture detecting sensor unit is provided on the filter member.

4. The clothing dryer of claim 3, wherein:

the filter member comprises a filter member body forming an exterior appearance of the filter member;

an air discharging port provided at the filter member body in the shape of a hollow hole such that the air passed through an inside the drying tub is discharged; and a sensor mounting part provided on the filter member body and at which the moisture detecting sensor unit is disposed.

5. The clothing dryer of claim 4, wherein:

the sensor mounting part comprises a first mounting part at which the moisture detection sensing part is mounted; and a second mounting part provided at one end portion of the first mounting part and at which the fixing-bent part is insertedly mounted.

6. The clothing dryer of claim 5, wherein:

the second mounting part is open toward a lower side thereof such that accumulated moisture is discharged therethrough.

7. The clothing dryer of claim 2, wherein:

the sensor partition wall comprises at least one moisture detection sensing part partition wall configured to divide the plurality of moisture detection sensing parts such that no foreign substance is stuck in between the plurality of moisture detection sensing parts.

8. The clothing dryer of claim 2, wherein:

the sensor partition wall comprises at least one fixing part partition wall configured to divide the plurality of fixing-bent parts such that no foreign substance is stuck in between the plurality of fixing-bent parts.

9. The clothing dryer of claim 1, wherein:

the plurality of moisture detecting sensor units comprise a pair of the moisture detecting sensor units provided in parallel to each other.

10. The clothing dryer of claim 2, wherein:

the plurality of fixing-bent parts comprise a hook inclination surface inclined in a direction opposite to an insertion direction in which the fixing bent part is inserted into the second mounting part to prevent the plurality of fixing-bent parts from being separated at the time of when the plurality of fixing-bent parts are being inserted into the filter member.

11. The clothing dryer of claim 2, wherein:

the plurality of moisture detecting sensor units further comprise a terminal connecting part bent from the other end portions of the moisture detection sensing parts to detect dryness of laundry and deliver the detected dryness of laundry to a control unit.

12. A clothing dryer, comprising:

a cabinet;

a drying tub disposed at an inner side of the cabinet to accommodate laundry;

a plurality of moisture detecting sensor units including a plurality of moisture detection sensing parts exposed toward an inside of the drying tub, and a plurality of fixing-bent parts extendedly formed from the plurality of moisture detecting sensor units such that the plurality of moisture detecting sensor units are fixed, to detect dryness of laundry accommodated at an inside the drying tub; and at least one sensor partition wall configured to divide the plurality of moisture detecting sensor units from each other, wherein the at least one sensor partition wall comprises at least one moisture detection sensing part partition wall dividing the plurality of moisture detection sensing parts from each other; and at least one fixing-hook part partition wall dividing the plurality of fixing-bent parts from each other.

13. The clothing dryer of claim 12, further comprising:

a first space at which the plurality of fixing-bent parts are mounted, and provided at one side thereof with a discharging opening to prevent moisture in the air inside the drying tub from being accumulated, wherein the at least one fixing-hook part partition wall is provided as to divide the first space.

14. The clothing dryer of claim 13, wherein:

the first space is divided by the at least one fixing-hook part partition wall.

15. The clothing dryer of claim 14, wherein:

the plurality of fixing-bent parts are disposed at the first spaces that are divided by the at least one fixing-hook part partition wall.

16. The clothing dryer of claim 12, further comprising:

a filter member provided in between the drying tub and a duct communicating with the drying tub and through which air passed through an inside the drying tub is discharged, to filter a foreign substance, wherein the plurality of moisture detecting sensor units are disposed on the filter member.

17. The clothing dryer of claim 12, wherein:

the plurality of moisture detection sensing parts are formed in a circumferential direction corresponding to a rotational direction of the drying tub.

18. The clothing dryer of claim 12, wherein:

the plurality of fixing-hook units are disposed as to be spaced apart from each other with respect to left and right directions.

* * * * *